US010054131B2

(12) United States Patent
Aynsley et al.

(10) Patent No.: US 10,054,131 B2
(45) Date of Patent: Aug. 21, 2018

(54) HIGH EFFICIENCY DUCTED FAN

(75) Inventors: Richard M. Aynsley, Doonan (AU); Richard A. Oleson, Lexington, KY (US)

(73) Assignee: DELTA T, LLC, Lexington, KY (US)

( * ) Notice: Subject to any disclaimer, the term of this patent is extended or adjusted under 35 U.S.C. 154(b) by 1517 days.

(21) Appl. No.: 12/730,521

(22) Filed: Mar. 24, 2010

(65) Prior Publication Data

US 2010/0247316 A1 Sep. 30, 2010

Related U.S. Application Data

(60) Provisional application No. 61/163,156, filed on Mar. 25, 2009.

(51) Int. Cl.

| | |
|---|---|
| ***F04D 29/34*** | (2006.01) |
| ***F04D 29/20*** | (2006.01) |
| ***F04D 29/26*** | (2006.01) |
| ***F04D 29/32*** | (2006.01) |

(52) U.S. Cl.

CPC ..... *F04D 29/34* (2013.01); *F04D 29/20* (2013.01); *F04D 29/263* (2013.01); *F04D 29/329* (2013.01)

(58) Field of Classification Search

CPC ..... F01D 5/025; F01D 5/30; F01D 5/3007; F04D 25/0613; F04D 29/34; F04D 29/703

USPC ..... 416/219 R, 220 A, 219 A, 248, 247 R; 415/220

See application file for complete search history.

(56) References Cited

U.S. PATENT DOCUMENTS

| | | | | | |
|---|---|---|---|---|---|
| 390,615 | A | * | 10/1888 | Nye | 416/220 R |
| 752,670 | A | * | 2/1904 | Hamilton | 416/220 R |
| 1,819,728 | A | * | 8/1931 | Baugh | 416/200 R |
| 2,142,370 | A | * | 1/1939 | Parkoff | 416/54 |
| 2,183,891 | A | * | 12/1939 | Newnham | 416/220 R |
| 2,628,019 | A | * | 2/1953 | Koch | 415/186 |
| 3,132,698 | A | * | 5/1964 | Lesher | 416/220 R |
| 4,031,601 | A | * | 6/1977 | Staub et al. | 29/889.21 |

(Continued)

FOREIGN PATENT DOCUMENTS

WO WO 2009/100052 8/2009

OTHER PUBLICATIONS

International Search Report dated May 20, 2010 for Application No. PCT/US2010/028422.

(Continued)

*Primary Examiner* — Woody Lee, Jr.
*Assistant Examiner* — Adam W Brown
(74) *Attorney, Agent, or Firm* — King & Schickli, PLLC

(57) ABSTRACT

A fan assembly comprises a hub and fan blades. The hub includes a plurality of sockets configured to receive complementary mounting blocks of the fan blades. The mounting blocks each include at least one tapered shoulder portion. The mounting blocks are each tapered along three dimensions. Each mounting block comprises a rear face seated against a complementary rear face of the corresponding socket and a front face that is exposed relative to the hub. A cap secures the fan blades to the hub. The fan assembly may also include one or more shrouds positioned about the fan blades. The one or more shrouds may be substantially straight cylinders, may be flared or bell-shaped, may comprise a cage, may have any other suitable configuration, or may be omitted altogether.

30 Claims, 9 Drawing Sheets

(56) References Cited

U.S. PATENT DOCUMENTS

| | | | | |
|---|---|---|---|---|
| 4,181,172 | A | 1/1980 | Longhouse | |
| 4,460,315 | A | 7/1984 | Tseng et al. | |
| 4,657,483 | A * | 4/1987 | Bede | 415/222 |
| 5,163,814 | A | 11/1992 | Hutter et al. | |
| 5,927,945 | A * | 7/1999 | Chen | 416/5 |
| 6,048,173 | A * | 4/2000 | Chen | 416/210 R |
| 6,139,277 | A * | 10/2000 | Lopatinsky | 416/220 A |
| 6,244,821 | B1 | 6/2001 | Boyd | |
| 6,699,014 | B1 | 3/2004 | Lam et al. | |
| 6,939,108 | B2 | 9/2005 | Boyd | |
| 7,252,478 | B2 | 8/2007 | Aynsley | |
| 7,284,960 | B2 | 10/2007 | Aynsley | |
| D587,799 | S | 3/2009 | Oleson | |
| D607,988 | S | 1/2010 | Oleson et al. | |
| 2008/0008596 | A1 | 1/2008 | Aynsley | |
| 2008/0014090 | A1 | 1/2008 | Aynsley et al. | |
| 2008/0213097 | A1 | 9/2008 | Oleson et al. | |
| 2009/0072108 | A1 | 3/2009 | Oleson | |
| 2009/0081045 | A1 | 3/2009 | Scherer et al. | |
| 2009/0097975 | A1 | 4/2009 | Aynsley et al. | |
| 2009/0162197 | A1 | 6/2009 | Klemo et al. | |
| 2009/0208333 | A1 | 8/2009 | Smith et al. | |

OTHER PUBLICATIONS

Written Opinion dated May 20, 2010 for Application No. PCT/US2010/028422.
U.S. Appl. No. 61/163,156, filed Mar. 25, 2009, Aynsley et al.
U.S. Appl. No. 61/165,582, filed Apr. 1, 2009, Woolcott.
U.S. Appl. No. 61/175,210, filed May 4, 2009, Oleson et al.
U.S. Appl. No. 61/248,158, filed Oct. 2, 2009, Aynsley et al.

* cited by examiner

HIGH EFFICIENCY DUCTED FAN

PRIORITY

This application claims priority to U.S. Provisional Patent Application Ser. No. 61/163,156, filed Mar. 25, 2009, entitled "High Efficiency Ducted Fan," the disclosure of which is incorporated by reference herein.

BACKGROUND

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010. The disclosures of each of those U.S. patents are incorporated by reference herein. Additional exemplary fans are disclosed in U.S. Pub. No. 2008/0008596, entitled "Fan Blades," published Jan. 10, 2008; U.S. Pub. No. 2009/0208333, entitled "Ceiling Fan System with Brushless Motor," published Aug. 20, 2009; and U.S. Provisional Patent App. No. 61/175,210, entitled "Ceiling Fan with Variable Blade Pitch and Variable Speed Control," filed May 4, 2009, the disclosures of which are also incorporated by reference herein. It should be understood that teachings herein may be incorporated into any of the fans described in any of the above-referenced patents, publications, or patent applications.

A fan blade or airfoil may include one or more upper air fences and/or one or more lower air fences at any suitable position(s) along the length of the fan blade or airfoil. Merely exemplary air fences are described in U.S. Provisional Patent App. No. 61/248,158, entitled "Air Fence for Fan Blade," filed Oct. 2, 2009, the disclosure of which is incorporated by reference herein. Alternatively, any other suitable type of component or feature may be positioned along the length of a fan blade or airfoil; or such components or features may simply be omitted.

The outer tip of a fan blade or airfoil may be finished by the addition of an aerodynamic tip or winglet. Merely exemplary winglets are described in U.S. Pat. No. 7,252,478, entitled "Fan Blade Modifications," issued Aug. 7, 2007, the disclosure of which is incorporated by reference herein. Additional winglets are described in U.S. Pub. No. 2008/0014090, entitled "Cuffed Fan Blade Modifications," published Jan. 17, 2008, filed Sep. 25, 2007, the disclosure of which is incorporated by reference herein. Still other exemplary winglets are described in U.S. Design Patent No. D587,799, entitled "Winglet for a Fan Blade," issued Mar. 3, 2009, the disclosure of which is incorporated by reference herein. In some settings, such winglets may interrupt the outward flow of air at the tip of a fan blade, redirecting the flow to cause the air to pass over the fan blade in a perpendicular direction, and also ensuring that the entire air stream exits over the trailing edge of the fan blade and reducing tip vortex formation. In some settings, this may result in increased efficiency in operation in the region of the tip of the fan blade. In other variations, an angled extension may be added to a fan blade or airfoil, such as the angled airfoil extensions described in U.S. Pub. No. 2008/0213097, entitled "Angled Airfoil Extension for Fan Blade," published Sep. 4, 2008, the disclosure of which is incorporated by reference herein. Other suitable structures that may be associated with an outer tip of an airfoil or fan blade will be apparent to those of ordinary skill in the art. Alternatively, the outer tip of an airfoil or fan blade may be simply closed (e.g., with a cap or otherwise, etc.), or may lack any similar structure at all.

The interface of a fan blade and a fan hub may also be provided in a variety of ways. For instance, an interface component is described in U.S. Pub. No. 2009/0081045, entitled "Aerodynamic Interface Component for Fan Blade," published Mar. 26, 2009, the disclosure of which is incorporated by reference herein. Alternatively, the interface of a fan blade and a fan hub may include any other component or components, or may lack any similar structure at all.

Fans may also include a variety of mounting structures. For instance, a fan mounting structure is disclosed in U.S. Pub. No. 2009/0072108, entitled "Ceiling Fan with Angled Mounting," published Mar. 19, 2009, the disclosure of which is incorporated herein. Of course, a fan need not be mounted to a ceiling or other overhead structure, and instead may be mounted to a wall or to the ground. For instance, a fan may be supported on the top of a post that extends upwardly from the ground. Alternatively, any other suitable mounting structures and/or mounting techniques may be used in conjunction with embodiments described herein.

It should also be understood that a fan may include sensors or other features that are used to control, at least in part, operation of a fan system. For instance, such fan systems are disclosed in U.S. Pub. No. 2009/0097975, entitled "Ceiling Fan with Concentric Stationary Tube and Power-Down Features," published Apr. 16, 2009, the disclosure of which is incorporated by reference herein; U.S. Pub. No. 2009/0162197, entitled "Automatic Control System and Method to Minimize Oscillation in Ceiling Fans," published Jun. 25, 2009, the disclosure of which is incorporated by reference herein; WIPO Pub. No. WO/2009/100052, entitled "Automatic Control System for Ceiling Fan Based on Temperature Differentials," published Aug. 13, 2009, the disclosure of which is incorporated by reference herein; and U.S. Provisional Patent App. No. 61/165,582, entitled "Fan with Impact Avoidance System Using Infrared," filed Apr. 1, 2009, the disclosure of which is incorporated by reference herein. Alternatively, any other suitable control systems/features may be used in conjunction with embodiments described herein.

While many versions of the fans disclosed in the above-cited patents and patent applications are configured to be mounted to a ceiling, such as to provide downward and/or outward airflow, fans may alternatively be mounted to a floor, wall, upright structure, or other structure, and may be positioned at a variety of different locations and orientations. Fans may thus be configured to provide airflow in a generally upward or horizontal direction (in addition to or in lieu of a downward direction). In any such case, the fan may be configured to provide a generally axial flow of air.

In some settings, the ability of an axial flow fan to propel air over a long distance along the axis of the fan may be enhanced by the provision of a cylindrical shroud closely fitted around the circle defined by the tips of the blades of the fan. In some settings, the efficiency of this combination may increase as the diameter of the inner surface of the cylindrical shroud approaches the diameter of the circle of the fan blade tips. However, unavoidable variations in manufacturing materials and processes may make it necessary to allow a degree of clearance between the blade tips and the shroud to prevent them from coming into contact with one another in operation.

While a variety of fans and fan systems have been made and used, it is believed that no one prior to the inventors has made or used a fan system as described herein.

BRIEF DESCRIPTION OF THE DRAWINGS

It is believed the present invention will be better understood from the following description of certain examples taken in conjunction with the accompanying drawings, in which like reference numerals identify the same elements and in which.

Figure 1:
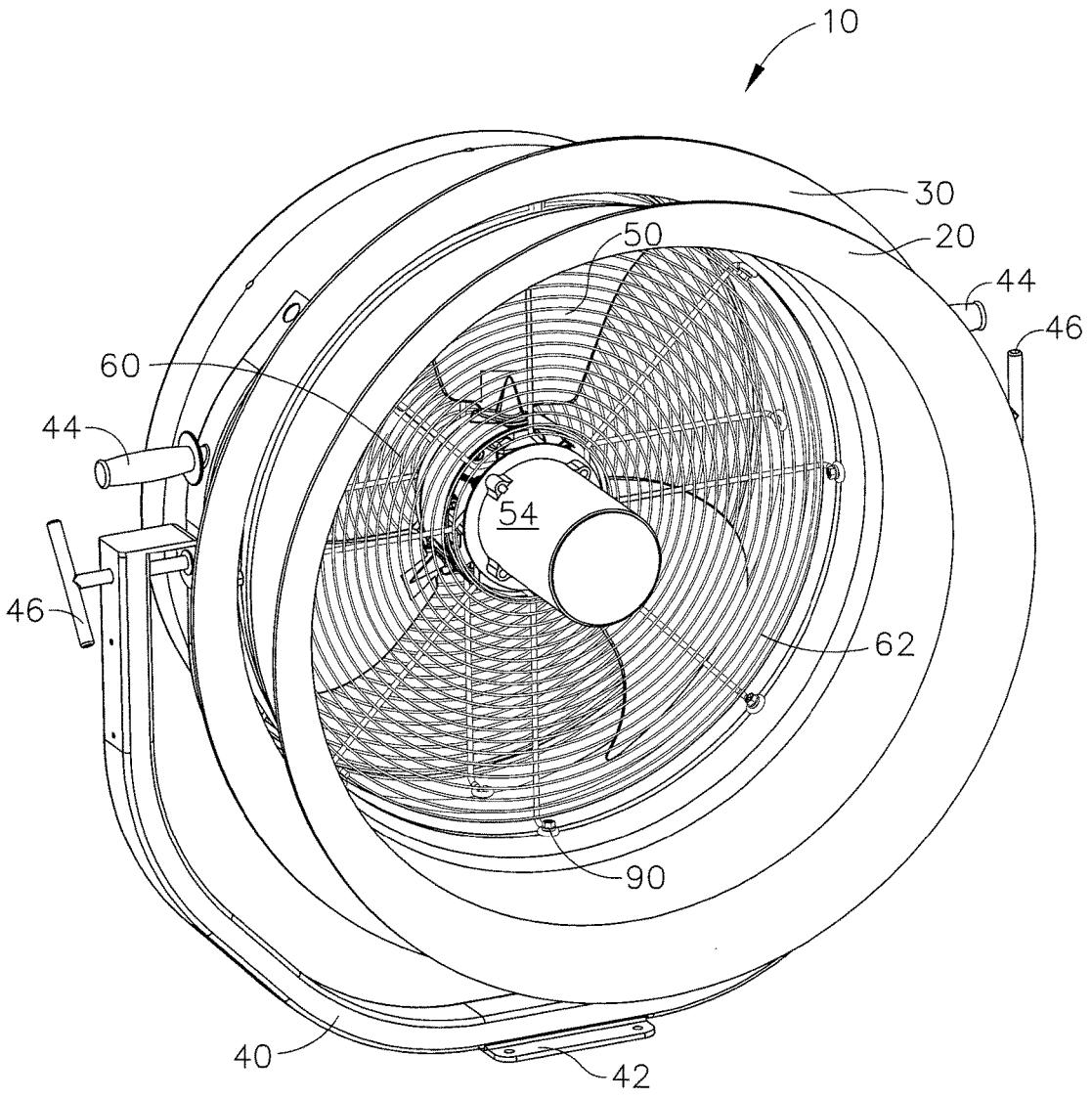
FIG. 1 depicts a perspective rear view of an exemplary ducted fan having a dual shroud.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 2:
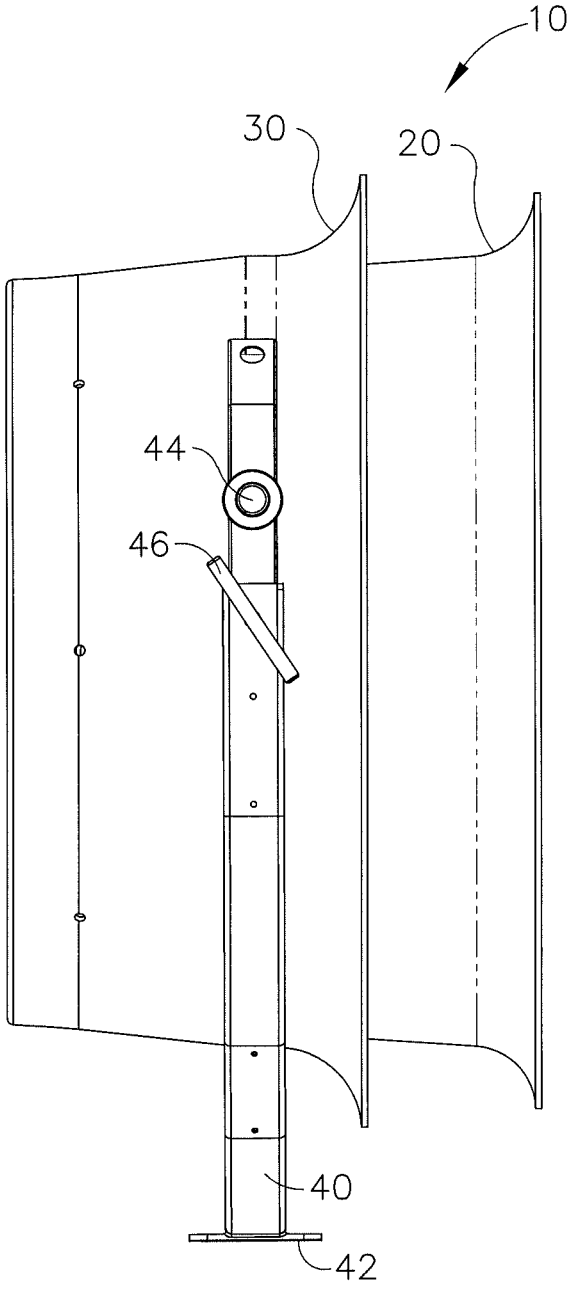
FIG. 2 depicts a side view of the fan of FIG. 1.
Figure 3:
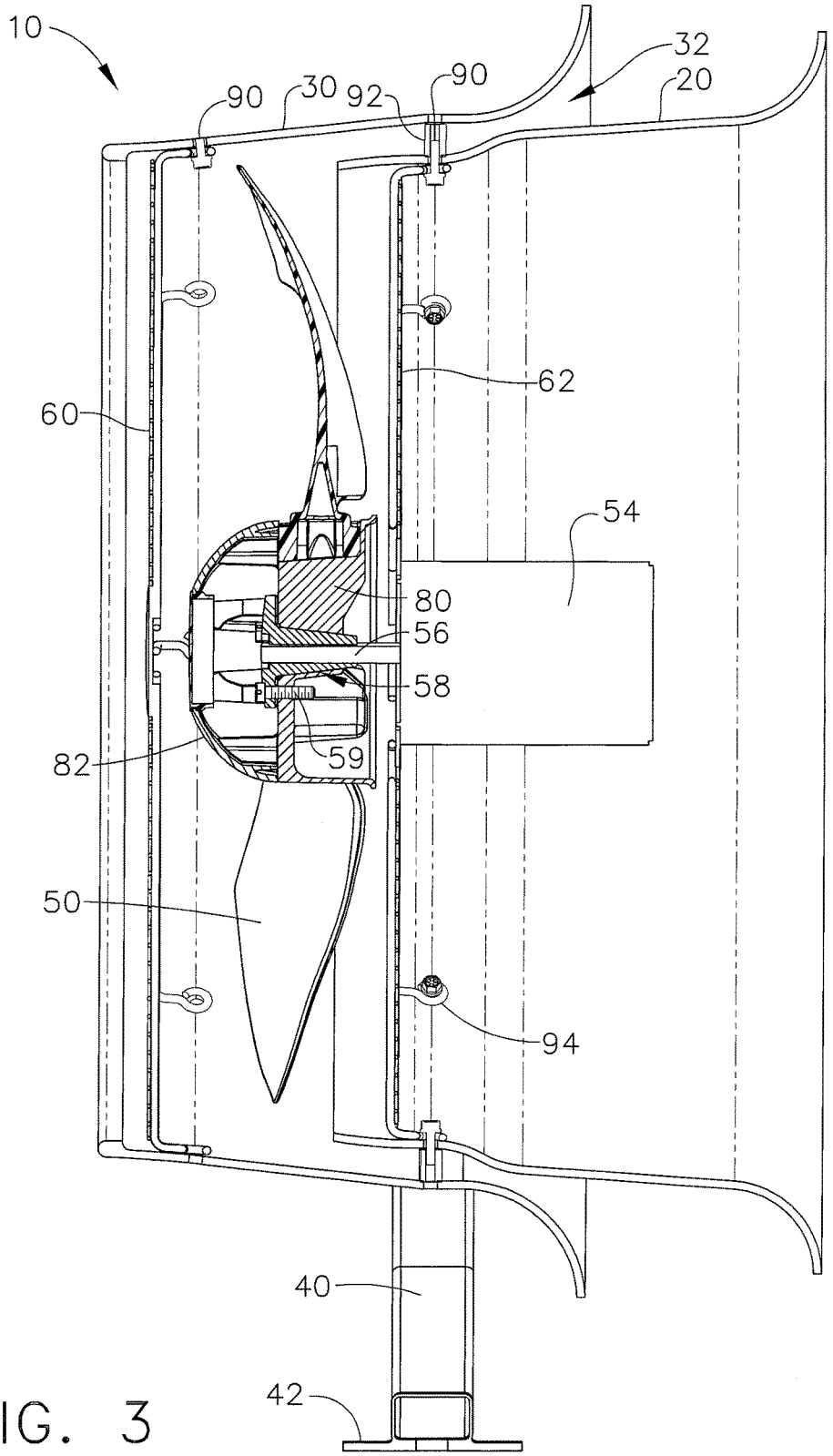
FIG. 3 depicts a side cross-sectional view of the fan of FIG. 1.

As shown in FIGS. 1-3, the fan (10) of the present example comprises a pair of shrouds (20, 30), a frame (40), and a plurality of blades (50). Blades (50) extend outwardly from a hub (80), which is coupled with a motor (54) that is operable to rotate hub (80) and blades (50). Frame (40) includes a bracket (42), and is pivotally coupled to outer shroud (30). Bracket (42) is configured to permit a user to mount fan (10) on a floor, wall, ceiling, or other structure, such as by using one or more fasteners (e.g., bolts, screws, etc.), adhesives, welding, or any other suitable means or techniques. A pair of handles (44) is provided to assist a user in rotationally positioning fan (10) relative to frame (40). In addition, a pair of rotatable handles (46) is provided at the pivot points of frame (40). Rotatable handles (46) of this example are operable to selectively substantially fix the rotational position of fan (10) relative to frame (40), such as upon sufficient rotation of rotatable handles (46). In other words, rotatable handles (46) may comprise threaded portions or other features configured to permit a user to tighten/untighten or otherwise selectively substantially fix the rotational position of fan (10) relative to frame (40). Of course, frame (40) of this example is merely exemplary, and any desired variations, substitutions, or supplementations may be made for frame (40). Alternatively, frame (40) may simply be omitted altogether. Likewise, handles (44) and/or handles (46) may be omitted if desired.

In the present example, inner shroud (20) is placed so that its front end is immediately behind the plane of fan blade (50) tips, thus permitting the smallest diameter of shroud (20) to be substantially equal to or even slightly smaller than the diameter of the circle defined by fan blade (50) tips. This may increase the efficiency and effectiveness of the fan/shroud combination beyond the limits obtainable with fan blades (50) fully enclosed within shroud (20). Alternatively, the smallest diameter of inner shroud (20) may have any other suitable relationship with the position of and/or diameter defined by fan blade (50) tips. As shown, the diameter of shroud (20) gradually increases along the axial dimension defined by fan (10), and then drastically increases at its rear edge to provide a flared or bell-shaped configuration.

Also in the present example, an outer shroud (30) is provided in a position and configuration that is displaced outwardly from inner shroud (20), with an air inlet region (32) to the rear of outer shroud (30), and with the front of outer shroud (30) extending forward beyond the plane of fan blades (50). Without being limited by theory, in accordance with the Bernoulli Principle, the high velocity of the air being propelled forward from fan blades (50) may create a negative pressure inside outer shroud (30). This negative pressure may then draw in an additional volume of air from the inlet region to the rear of outer shroud (30), adding this to the volume of air propelled directly through fan blades (50) and further increasing the efficiency of the combination.

In the present example, the rearward end of inner shroud (20) may be expanded in a bell shape to facilitate the smooth flow of air into fan (10). Alternatively, any other suitable shapes or configurations may be used. Also in the present example, the rearward end of outer shroud (30) is also expanded in a bell shape to facilitate the smooth flow of air into the region of negative pressure forward of fan blades (50) inside shroud (30). Again, though, any other suitable shapes or configurations may be used. Furthermore, either inner shroud (20) or outer shroud (30), or both, may be tapered in a conical form rather than cylindrical, or have any other suitable shape or configuration.

In some versions, the minimum distance between the outer surface of inner shroud (20) and the inner surface of outer shroud (30) may be approximately, 0.5 inch. Alternatively, the distance between the outer surface of inner shroud (20) and the inner surface of outer shroud (30) may be between approximately 0.25 inch, inclusive, and approximately 0.75 inch, inclusive; between approximately 0.1 inch, inclusive, and approximately 1.0 inch, inclusive; or may fall within any other suitable range.

By way of example only, the two shrouds (20, 30) may be manufactured of either a metal, a fiberglass composite, or a thermoplastic material. Alternatively, any other suitable material(s) may be used. In addition, suitable manufacturing processes for the two shrouds (20, 30) may include metal spinning, sheet metal forming, fiberglass hand layup, sprayup, liquid resin perform molding or SMC compression molding, or thermoplastic thermoforming, or rotational molding. Alternatively, any other suitable process(es) may be used.

It should be understood that the above-described configuration of shrouds (20, 30) is merely exemplary, and that shrouds (20, 30) may have a variety of other configurations or may even be omitted altogether. For instance, in some other versions, inner shroud (20) is omitted entirely from fan (10), and outer shroud (30) is used alone. A merely illustrative example of such a version of fan (10) is shown and described in U.S. Provisional Patent Application Ser. No. 61/163,156, filed Mar. 25, 2009, entitled "High Efficiency Ducted Fan," the disclosure of which is incorporated by reference herein. In some other versions, bell-shaped shrouds (20, 30) are omitted, and a single straight shroud (not shown) is used. Such a single straight shroud may be substantially cylindrical instead of being bell-shaped. Such a single straight shroud may also be fitted at any suitable position and at any suitable spacing from blades (50). For instance, a single straight shroud may have an inner diameter that is between approximately one inch away from the outer tips of blades (50), inclusive, and approximately three inches away from the outer tips of blades (50), inclusive. Other suitable distances between the inner diameter of a shroud and the outer tips of blades (50) will be apparent to those of ordinary skill in the art in view of the teachings herein. Similarly, various other suitable shapes and configurations that may be used for one or more shrouds will be apparent to those of ordinary skill in the art in view of the teachings herein. As yet another merely illustrative example where shrouds are omitted entirely, fan (10) may include an outer cage, such as an open cage or a closed cage.

Figure 4:
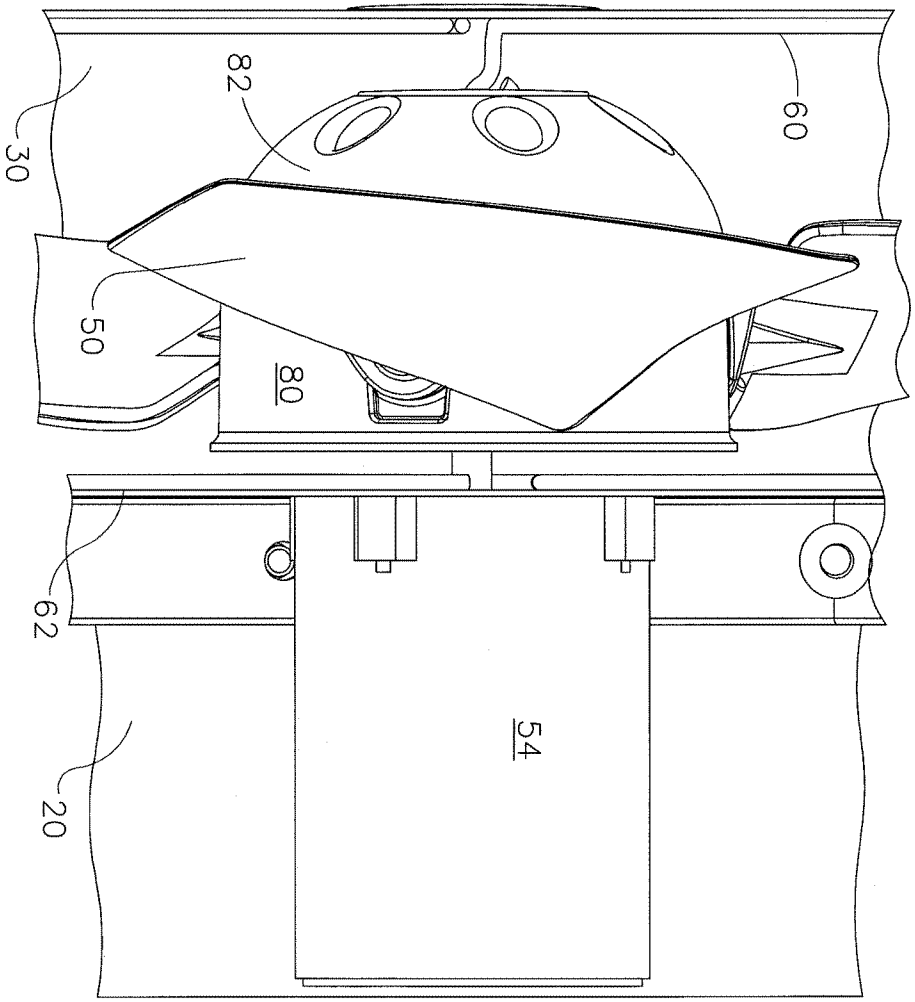
FIG. 4 depicts a partial plan view of the fan of FIG. 1, showing an exemplary pitch near the tip of the fan blade.

As shown in FIGS. 1 and 3-5, guards (60, 62) are positioned within each shroud (20, 30), on opposite sides of blades (50). Guards (60, 62) have a grille form, permitting air to pass therethrough. As shown in FIGS. 1 and 4, motor (54) and blades (50) are supported by a rear guard (62) in this example. In particular, rear guard (62) provides support by eight radial spokes, which are reinforced by a wire spiral that runs generally perpendicular to the spokes and is welded to the spokes at all intersection points. Front guard (60) of the present example has a similar construction.

In the present example, and as shown in FIGS. 1 and 3, inner shroud (20) is secured to rear guard (62) by eight outwardly directed radial pins (90), which are rigidly attached to inner shroud (20) and which pass through loops (94) at the ends of each of the eight spokes of rear guard (62). Of course, any other suitable components or configurations may be used to secure inner shroud (20) relative to rear guard (62). Outer shroud (30) may be similarly coupled with front guard (60) with inwardly directed radial pins (90) Inner shroud (20) may also be coupled with outer shroud (30) by pins (90) and spacers (92) as shown in FIG. 3. To the extent that inner shroud (20) is omitted, shroud (30) may be coupled with rear guard (62) by pins (90) in a manner similar to its engagement with front guard (60) or in any other suitable fashion.

It should be understood that pins (90) may prevent movement of shroud(s) (20, 30) in a direction perpendicular to the axis of pins (90), such that pins (90) rigidly secure mounting of shroud(s) (20, 30) concentric to guards (60, 62). However, pins (90) may also permit shroud(s) (20, 30) to move axially relative to each pin (90) at the respective pin (90) location, thus permitting shroud(s) (20, 30) to expand and contract freely relative to guards (60, 62) under the effects of varying temperature or other conditions, without necessarily resulting in deformation of guard(s) (20, 30) or other components of fan (10). In the example shown in FIG. 3, spacers (92) may also permit some degree of movement of shrouds (20, 30) relative to each other and relative to rear guard (62) along the axis of each respective pin (90). Pins (90) may thus be viewed as providing a "floating assembly." It should be understood that either or both guards (60, 62) may have any other suitable alternative components or configurations, and that guards (60, 62) may perform a variety of other functions in addition to or in lieu of those described herein. It should also be understood that motor (54), blades (50) and/or shrouds (20, 30) may be supported by any other suitable structure(s) in addition to or in lieu of being supported by guards (60, 62). Similarly, any other components or configurations may be provided in addition to or in lieu of pins (90), such as to provide some other type of floating assembly or even a non-floating assembly.

Furthermore, the pitch of fan blades (50) in the present example is correspondingly steeper than might otherwise be found in higher-RPM fans to produce a high axial flow at a slower motor (54) speed. The leading edge of each blade (50) is curved so that the initial surface area cutting the air is minimized, thus reducing the magnitude of the shock wave created as blade (50) advances through the air. The curvature of blade (50) is also a complex, three dimensional curve configured to produce a relatively uniform axial velocity across the column of air, both to maximize air flow efficiency and to minimize turbulence and noise. Suitable examples of such pitch and curvature will be described in greater detail below with reference to FIGS. 3-5, while other suitable configurations will be apparent to those of ordinary skill in the art in view of the teachings herein.

Figure 5:
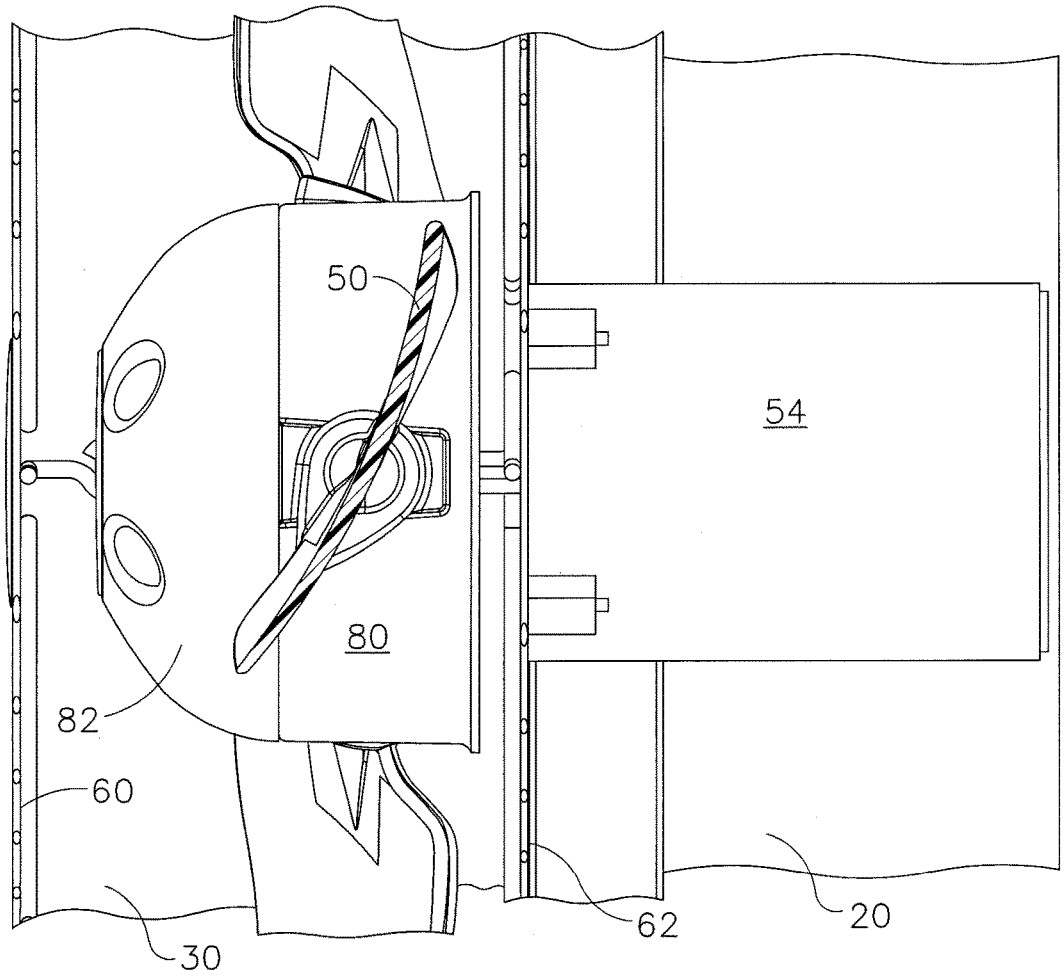
FIG. 5 depicts a partial plan view of the fan of FIG. 1, showing a fan blade in cross section to show an exemplary pitch near the root of the fan blade.

Exemplary geometric properties of fan blades (50) are shown in FIGS. 3-5. In particular, FIG. 3 shows a fan blade (50) having a forward rake angle of approximately 15 degrees. Such a forward rake angle may focus the outward flow stream into a relatively tighter, more compact vortex than may be achieved using another configuration for fan blade (50). In other words, a forward rake angle may increase the "throw distance" of the projected air stream. Of course, 15 degrees is just one example of a suitable forward rake angle. In other versions, fan blades (50) are configured to have a forward rake angle anywhere between approximately 10 degrees, inclusive, and approximately 20 degrees, inclusive; between approximately 5 degrees, inclusive, and approximately 25 degrees, inclusive; or between approximately 2 degrees, inclusive, and approximately 30 degrees, inclusive. Alternatively, fan blades (50) may have any suitable forward rake angle falling within any suitable range. In still other versions, fan blades (50) have a rearward rake angle or no rake angle at all (e.g., extend completely perpendicular from hub (52), etc.).

FIG. 4 shows an exemplary pitch near the tip of a fan blade (50). As shown, this near-tip pitch may be approximately 8 degrees. In other versions, fan blades (50) are configured to have a near-tip pitch anywhere between approximately 5 degrees, inclusive, and approximately 10 degrees, inclusive; between approximately 3 degrees, inclusive, and approximately 15 degrees, inclusive; or between approximately 2 degrees, inclusive, and approximately 25 degrees, inclusive. Alternatively, fan blades (50) may have any suitable near-tip pitch falling within any suitable range. FIG. 5 shows an exemplary pitch near the root of a fan blade (50). As shown, this near-root pitch may be approximately 31 degrees. In other versions, fan blades (50) are configured to have a near-root pitch anywhere between approximately 25 degrees, inclusive, and approximately 35 degrees, inclusive; between approximately 20 degrees, inclusive, and approximately 40 degrees, inclusive; or between approximately 15 degrees, inclusive, and approximately 45 degrees, inclusive. Alternatively, fan blades (50) may have any suitable near-root pitch falling within any suitable range. In addition, fan blade (50) of this example reaches a maximum pitch angle of approximately 32.5 degrees at the extreme (inboard) root edge of fan blade (50). Of course, this extreme root pitch may be at any other suitable angle, including but not limited to falling within any of the above-noted angular ranges for the near-root pitch.

As will be appreciated in view of FIGS. 4-5 and the above description, fan blades (50) have a generally twisted configuration, with the pitch of each fan blade (50) varying along its length. In particular, the pitch is steeper at the root of each fan blade (50) and flatter at the tip of each fan blade (50). In some other versions, the pitch is steeper at the tip of each fan blade (50) and flatter at the root of each fan blade (50). It should be understood that the pitch of a fan blade (50) may vary at any suitable rate along its length. It should also be understood that a portion of a fan blade (50) may be twisted or pitched while another portion of fan blade (50) is not. Furthermore, a fan blade (50) with no twisting may be used, if desired. Still other suitable geometries for fan blades (50) will be apparent to those of ordinary skill in the art in view of the teachings herein.

By way of example only, blades (50) may present a diameter of approximately 30 inches. Alternatively, any other suitable sizes may be used.

In some versions, motor (54) comprises a symmetrically wound, permanent split capacitor AC induction motor. In some settings, this type of motor (54) may provide quieter operation than some conventional capacitor-start induction motors due to the symmetry of its winding design. In some other versions, motor (54) comprises an electronically commutated, variable speed brushless AC motor. In some settings, such a motor (54) may provide improved efficiency and quieter operation compared to a conventional AC induction motor. Of course, any other suitable type of motor (54) may be used.

As shown in FIG. 3, a drive shaft (56) extends from motor (54). Motor (54) is operable to rotate drive shaft (56). Hub (80) is unitarily secured to drive shaft (56) by a taper lock bushing (58), which is secured to hub (80) by bolts (59). Hub (80) thus rotates unitarily with drive shaft (54) when motor (54) is activated. With blades (50) being secured to hub (80) as described in greater detail below, blades (50) also rotate when motor (54) is activated. Some versions of fan (10) operate at a rotational speed of approximately 1725 RPM. In some other versions, fan (10) operates at a selected one of two speeds, either approximately 800 RPM or approximately 1100 RPM; or at a selected one of three or more speeds. In some settings, such speeds may provide relatively quieter operation. Of course, fan (10) may be operated at any other desired speed(s).

Figure 6:
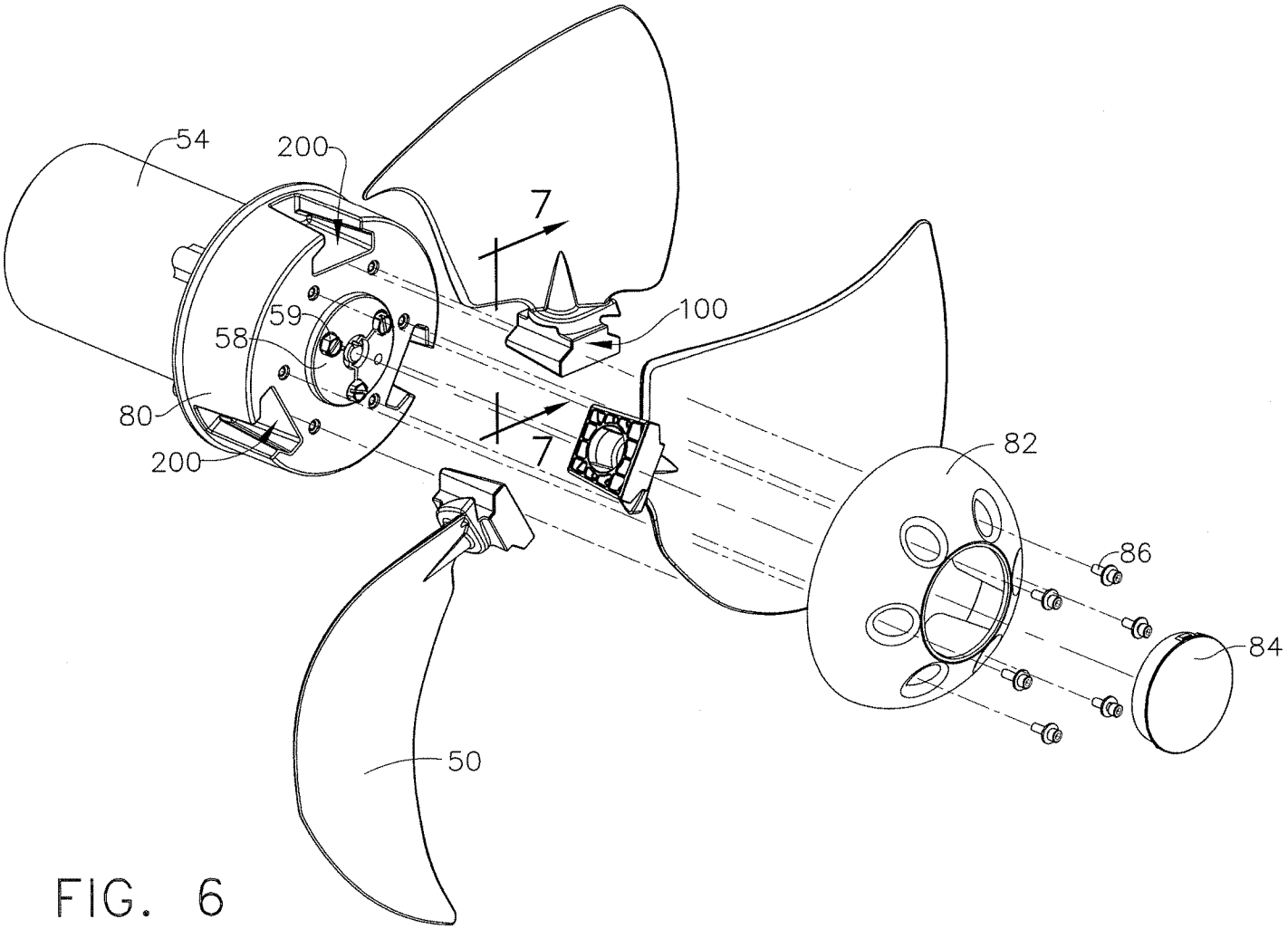
FIG. 6 depicts an exploded view of the fan blades, fan hub, and motor assembly of the fan of FIG. 1.
Figure 7:
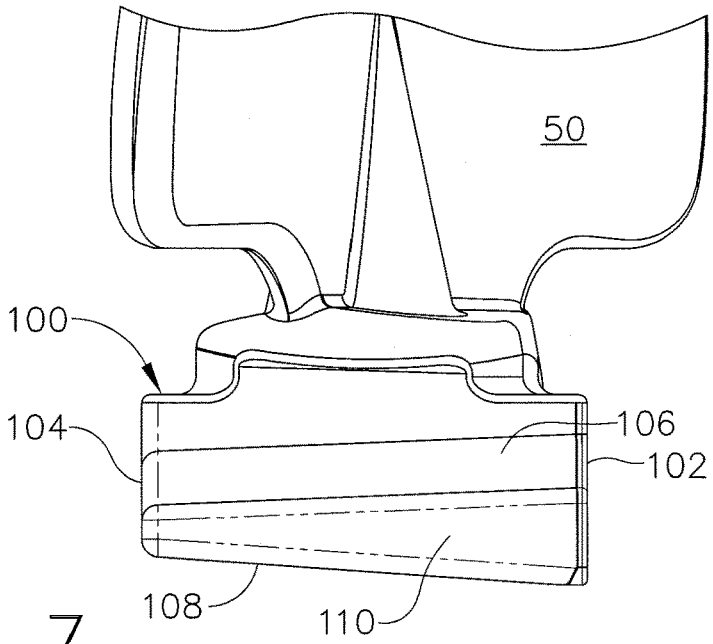
FIG. 7 depicts a partial side view of a fan blade of the fan of FIG. 1, showing a side profile of a mounting block of the fan blade.
Figure 8:
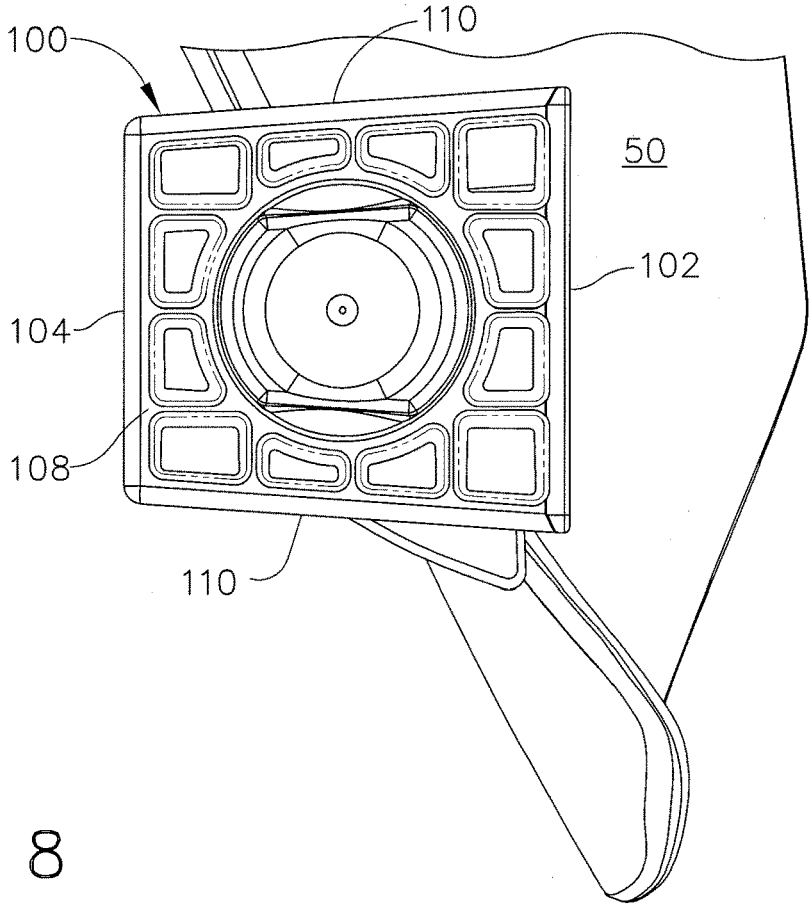
FIG. 8 depicts a partial bottom view of the fan blade of FIG. 7, showing a footprint of the mounting block of the fan blade.
Figure 9:
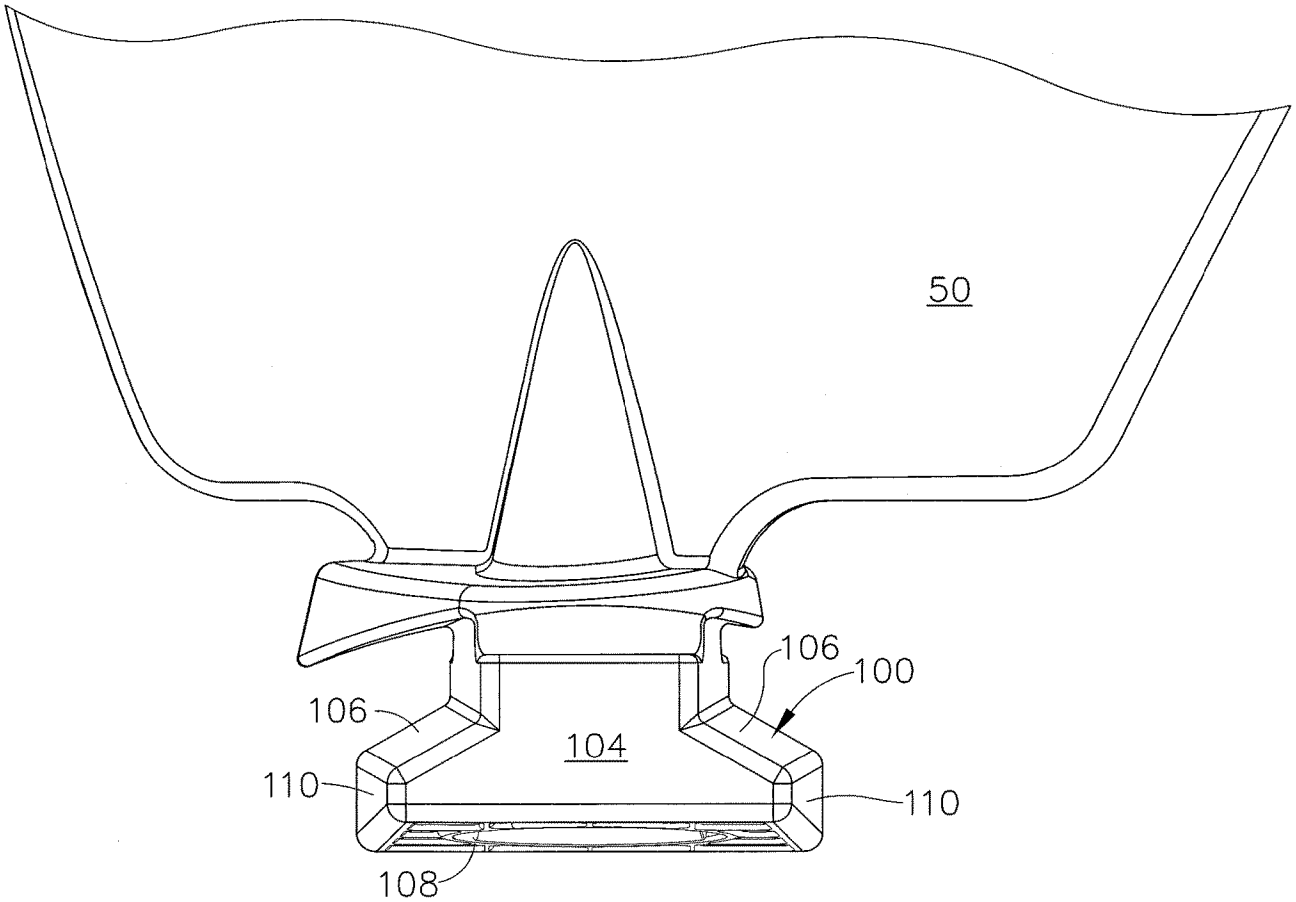
FIG. 9 depicts a partial rear view of the fan blade of FIG. 7, showing a rear profile of the mounting block of the fan blade.
Figure 10:
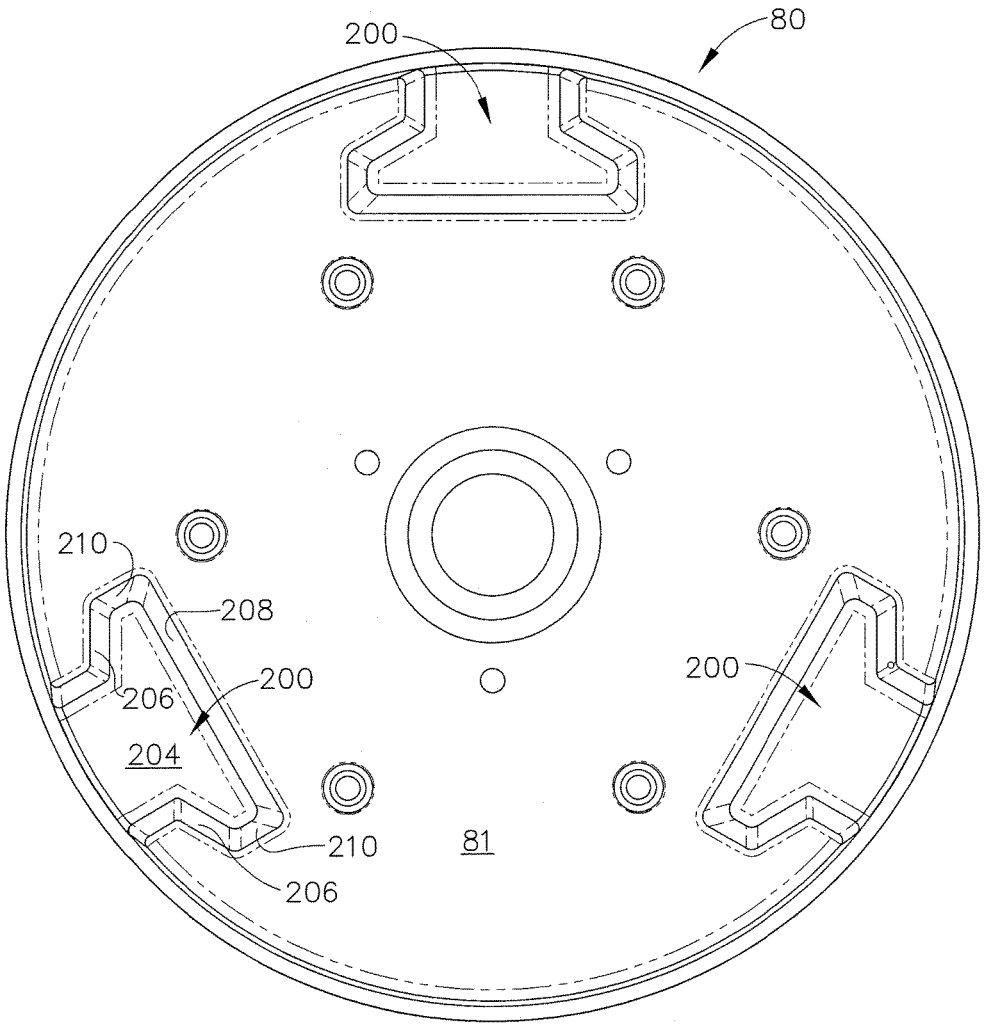
FIG. 10 depicts a front view of the hub of the fan of FIG. 1.

FIG. 6 depicts one example of how fan blades (50) may be secured to hub (52). s shown, each fan blade (50) includes an integral tapered block (100) at its root. Hub (80) has a plurality of axially oriented tapered sockets (200), which are configured to receive tapered blocks (100). Blocks (100) and sockets (200) are complementary in the present example, and are shaped to provide a snug fit between fan blades and hub (80). As shown in FIGS. 7-9, each block (100) of the present example includes a front face (102), a rear face (104), two top faces (106), a bottom face (108), and two side faces (110). As can be seen in FIG. 9, top faces (106) extend outwardly, forming shoulders of block (100). In some other versions, each block (100) only has one such shoulder. As shown in FIG. 10, each socket (200) of the present example includes a rear face (204), two top faces (206), a bottom face (208), and two side faces (210). Rear face (204) of socket (200) complements rear face (104) of block (100). Top faces (206) of socket (100) complement top faces (106) of block (100). Bottom face (208) of socket (200) complements bottom face (108) of block (100). Side faces (210) of socket (200) complement side faces (110) of block (100).

It should be understood that block (100) and socket (200) are each tapered along three dimensions in the present example. Due to this tapered configuration, front face (102) has a larger footprint than rear face (104). With faces (102, 104) both being substantially flat and continuous in the present example, this larger footprint means that front face (102) has a greater surface area than rear face (104). Of course, front face (102) may still have a larger footprint than rear face (104) without necessarily also having a greater surface area in some other versions (e.g., where either face (102, 104) is not substantially flat or continuous, etc.). As best seen in FIG. 8, bottom face (108) of each block (100) is tapered such that its width at front face (102) is wider than its width at rear face (104). Bottom face (108) thus has a trapezoidal shape in the present example. As can be seen in FIG. 9, bottom face (108) is also angled such that its end at rear face (104) tilts toward the outer tip of fan blade (50). As best seen in FIG. 7, side faces (110) of each block (100) are tapered such that their height at front face (102) is greater than their height at rear face (104). As can be seen in FIG. 9, side faces (110) also tilt inwardly toward each other from front face (102) to rear face (104). As can also be seen in FIG. 9, the taper of side faces (110) provides a tilted orientation of top faces (206), such that side faces (110) tilt toward bottom face (108) from front face (102) to rear face (104). The complementary relationship between blocks (100) and sockets (200) provides similar configurations for faces (204, 206, 208, 210) of socket (200). Of course, blocks (100) and sockets (200) may have any other suitable configurations and/or structural relationships with each other.

During assembly of fan (10), each blade (50) is secured to hub (80) by inserting block (100) into socket (200) by orienting blade (50) such that bottom rear face (104) of block (100) is facing rear face (204) of socket (200), then pushing block (100) in a direction substantially parallel to the axis defined by hub (80). With block (100) fully inserted in socket (200), faces (104, 106, 108, 110) of block (100) contact complementary faces (204, 206, 208, 210) of socket (200). Such a fit may be relatively loose, snug, an interference fit, or be any other suitable type of fit. In addition, front face (102) of block (100) is substantially flush with front face (81) of hub (80) when block (100) is inserted in socket (200) in the present example. With blocks (100) seated in sockets (200) in this example, a cap (82) may be positioned over the same, and a plurality of bolts (86) may be inserted through cap (82) and secured within threaded openings formed in hub (80). A cap (82) so secured may prevent blocks (100) from moving longitudinally out of sockets (200), such that cap (82) may retain fan blades (50) relative to hub (80). The resulting configuration of these components may provide a rigid attachment of fan blades (50) to hub (80), and may also provide consistent positioning and pitch of blades (50). The axial insertion of blocks (100) may also provide resistance to effects of centrifugal force during operation of fan (10). Of course, any other suitable structures, devices, and techniques may be used to secure fan blades (50) relative to a hub (80). By way of example only, fan blades (50) may be integrally formed with a hub (80) (e.g., molded integrally) in some variations. In the present example, a secondary cap (84) is inserted in a central opening of cap (82), though it should be understood that secondary cap (84) is merely optional.

In the present example, the relative configuration of fan blades (50) and hub (80) may permit an operator to change out fan blades (50). For instance, different settings may call for different types of fan blades (50) (e.g., different configurations of fan blades (50), different weights for balancing, etc.); and the removability and replaceability of fan blades (50) may permit the operator to reconfigure the fan (10) without having to replace it entirely. As one merely illustrative example, some settings or motor types may warrant using blades (50) of one weight while other settings or motor types may warrant using blades (50) of another weight. The relative configuration of fan blades (50) and hub (80) of the present example may allow the operator to change out blades (50) such that the weights of blades (50) are approximately matched with relative ease. As another merely illustrative example, manufacturing imperfections in hub (80) or blades (50) may warrant changing one or more blades (50) for balancing purposes while leaving other blades (50) unchanged. A blade (50) may also be replaced with relative ease in the event of wear or damage. Thus, blades (50) may be replaced for any desired reason with relative ease.

By way of example only, hub (80) may be formed of cast aluminum, while caps (82, 84) may be formed of polyamide composite. Alternatively, any other suitable material(s) or technique(s) may be used, including combinations thereof.

It should be understood that blocks (100) and sockets (200) as described herein may be incorporated into blades and a hub of virtually any type of fan having blades that extend generally outwardly from a hub. By way of example only, blocks (100) and sockets (200) may be readily incorporated into the blades and hub of any fan described in any patent, publication, or patent application that is referenced herein. Various suitable ways in which blocks (100) and sockets (200) may be incorporated into the blades and hub of such fans will be apparent to those of ordinary skill in the art in view of the teachings herein. Similarly, various other types of fans in which blocks (100) and sockets (200) may be incorporated, as well as various suitable ways in which blocks (100) and sockets (200) may be incorporated into the blades and hub of such fans, will be apparent to those of ordinary skill in the art in view of the teachings herein. It should therefore be understood that the use of blocks (100) and sockets (200) is not limited to fan (10), ducted fans in general, or other particular fans.

Fan (10) may also make use of vibration damping, viscoelastic polymer and composite materials in the interest of reducing high frequency noise as compared to comparable fans of metal construction. For instance, fan blades (50) may be composed of a glass fiber/thermoplastic polyamide composite; and inner and outer shrouds (20, 30) may be composed of high density thermoplastic polyolefin. Both of these materials may provide significant sound damping properties as compared to metals. Alternatively, some or all of fan (10) may be made of metal and/or any other suitable material(s), including various combinations of materials.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of claims that may be presented, and is understood not to be limited to the details of structure and operation shown and described in the specification and drawings.

We claim:

1. A fan assembly, comprising: (a) a hub, wherein the hub includes a plurality of sockets, wherein each socket has at least one tapered sidewall, wherein the hub is rotatable about a hub axis, wherein each socket extends along a direction that is substantially parallel to the hub axis; and (b) a plurality of fan blades, wherein each fan blade includes a block, wherein each block is inserted in a corresponding socket of the plurality of sockets, wherein each block has at least one tapered portion, wherein each fan blade extends along a respective fan blade axis, wherein the fan blade axes extend outwardly from the hub axis; wherein the at least one tapered sidewall of each socket complements the at least one tapered portion of each corresponding block, wherein at least one of the sockets is adapted for receiving the corresponding block upon insertion along the tapered sidewall in a direction that is substantially parallel to the hub axis wherein each block has a front face, a rear face, two top faces, a bottom face, and two side faces, wherein each side face extends from the bottom face to a corresponding top face of the two top faces, wherein each of the side faces are tapered toward each other from the front face to the rear face, and each of the side faces are further tapered to provide a tilted orientation of the top faces of each block such that the side faces tilt toward the bottom face from the front face to the rear face of each block.

2. The fan of claim 1, wherein each block further comprises a rigid shoulder, wherein the shoulder of each block extends outwardly from the fan blade axis of the corresponding fan blade in a circumferential direction.

3. The fan of claim 2, wherein the at least one tapered portion of each block is provided on the shoulder of the block.

4. The fan of claim 1, wherein the hub presents a front face, wherein each socket has a rear face, each socket rear face being recessed relative to the front face of the hub.

5. The fan of claim 4, wherein the rear face of each of the blocks are configured to fully insert and contact a corresponding socket rear face.

6. The fan of claim 4, wherein the front face of each of the blocks are spaced from the rear face in the direction that is substantially parallel to the hub axis, wherein the front face of each block is substantially flush with an opening of the corresponding socket when the blocks are fully inserted in the corresponding sockets.

7. The fan of claim 1, wherein the front face has a larger footprint than the rear face.

8. The fan of claim 7, wherein the front face has a larger surface area than the rear face.

9. The fan of claim 1, wherein the bottom face has a trapezoidal shape.

10. The fan of claim 9, wherein the side faces are further tapered such that the top faces are non-parallel with the bottom face.

11. The fan of claim 1, further comprising at least one shroud positioned about the fan blades.

12. The fan of claim 1, further comprising at least two shrouds positioned about the fan blades.

13. The fan of claim 1, further comprising a frame, wherein the hub is pivotable relative to the frame to re-orient the hub axis.

14. The fan of claim 1, wherein each fan blade is twisted about the corresponding fan blade axis.

15. The fan of claim 14, wherein each fan blade has a tip portion defining a tip portion pitch and a root portion defining a root portion pitch, wherein the root portion pitch is greater than the tip portion pitch.

16. A fan blade, the fan blade comprising: (a) a blade portion; and (b) a rigid block portion having two side faces, wherein the block portion is configured to removably secure the blade portion to a fan hub, wherein the blade portion and the block portion together define a fan blade axis, wherein each of the two side faces include three distinct tapers.

17. A method of assembling a fan, wherein the fan comprises a hub having sockets and a plurality of fan blades having mounting blocks, wherein the hub is rotatable about a hub axis, wherein each mounting block has a front face, a rear face, two top faces, a bottom face, and two side faces, wherein each top face extends outwardly forming a tapered shoulder portion, wherein each side face extends from the bottom face to a corresponding top face of the two top faces, wherein each of the side faces are tapered toward each other from the front face to the rear face and wherein each of the side faces are further tapered to provide a tilted orientation of the top faces of each block such that the side faces tilt toward the bottom face from the front face to the rear face of each block, the method comprising: (a) inserting each mounting block into a corresponding socket of the hub wherein the act of inserting comprises moving each block along a direction that is substantially parallel to the hub axis into a socket having an opening and along a tapered sidewall of the socket for receiving the block in the direction.

18. The method of claim 17 further including the step of securing a cap to the hub to substantially secure the fan blades to the hub along the direction that is substantially parallel to the hub axis.

19. The method of claim 17, wherein the fan includes a shroud generally concentric with and substantially surrounding the hub, and the inserting step comprises passing the fan blade axially within the shroud.

20. The method of claim 17, wherein the inserting step comprises inserting a narrow end of the block into the opening of the corresponding socket before a wider end of the block.

21. The apparatus of claim 1, wherein the block is rigid.

22. The apparatus of claim 1, wherein the block is wider at the front face than at the rear face.

23. The apparatus of claim 1, wherein the at least one tapered portion of the block tapers in the direction substantially parallel to the hub axis.

24. The apparatus of claim 1, wherein the block is tapered along three dimensions.

25. The apparatus of claim 22, wherein the hub includes a rear wall for engaging the rear face of the block, and the rear wall having an opening formed therein for receiving a portion of the fan blade.

26. The apparatus of claim 1, wherein each socket is T-shaped.

27. The apparatus of claim 26, wherein each mounting block is T-shaped.

28. The apparatus of claim 1, wherein each of the side faces are further tapered such that a height of each of the side faces at the front face of each block is greater than the height of each of the side faces at the rear face of each block.

29. The fan blade of claim 16, wherein each block portion further has a front face, a rear face, two top faces and a bottom face.

30. The fan blade of claim 29, wherein the three distinct tapers of each of the side faces include the side faces being: (i) tapered toward each other from the front face of each block to a rear face of each block; (ii) tapered such that a height of each of the side faces at the front face of each block is greater than the height of each of the side faces at the rear face of each block; and (iii) tapered to provide a tilted orientation of the two top faces of each block such that the side faces tilt toward the bottom face from the front face to the rear face of each block.

* * * * *